US010959005B2

(12) United States Patent
Yoneyama

(10) Patent No.: US 10,959,005 B2
(45) Date of Patent: Mar. 23, 2021

(54) HEADPHONE

(71) Applicant: AUDIO-TECHNICA CORPORATION, Tokyo (JP)

(72) Inventor: Daisuke Yoneyama, Kanagawa (JP)

(73) Assignee: AUDIO-TECHNICA CORPORATION, Tokyo (JP)

( * ) Notice: Subject to any disclaimer, the term of this patent is extended or adjusted under 35 U.S.C. 154(b) by 0 days.

(21) Appl. No.: 16/726,365

(22) Filed: Dec. 24, 2019

(65) Prior Publication Data

US 2020/0213703 A1 Jul. 2, 2020

(30) Foreign Application Priority Data

Dec. 26, 2018 (JP) ..... JP2018-242607

(51) Int. Cl.
*H04R 1/10* (2006.01)
*H04R 1/08* (2006.01)

(52) U.S. Cl.
CPC ..... *H04R 1/1008* (2013.01); *H04R 1/08* (2013.01); *H04R 1/1075* (2013.01); *H04R 2460/11* (2013.01)

(58) Field of Classification Search
CPC .. H04R 1/1008; H04R 1/1016; H04R 1/1075; H04R 1/1091; H04R 1/08; H04R 1/05; H04R 5/033; H04R 2201/10; H04R 2460/11
USPC ..... 381/370–376, 382, 337, 338, 74; 181/128, 129
See application file for complete search history.

(56) References Cited

U.S. PATENT DOCUMENTS 4,742,887 A * 5/1988 Yamagishi ..... H04R 1/22 181/129
5,579,398 A * 11/1996 Ewens ..... H04M 1/03 181/138
7,916,888 B2 * 3/2011 Sapiejewski ..... H04R 1/2849 381/382

(Continued)

FOREIGN PATENT DOCUMENTS

EP 3 264 791 A1 1/2018
JP 2011 155331 A 8/2011

(Continued)

*Primary Examiner* — Xu Mei
(74) *Attorney, Agent, or Firm* — W & C IP

(57) ABSTRACT

A headphone in which the air pressure in a front cavity can be released to an external space, and whose characteristics in a low frequency range can be simply and finely adjusted is provided. The headphone includes: a driver unit; a baffle member holding the driver unit; the passage forming member attached to the baffle member and forming a vent passage with the baffle member; an ear pad defining a first space; and a cover member defining a second space. The baffle member includes: a first surface facing the first space; a second surface facing the second space; and a first through hole communicating with an internal space of the vent passage. The passage forming member includes a second through hole communicating with the internal space of the vent passage. The second space communicates with an external space of the cover member. The first space communicates with the second space through the first through hole, the vent passage, and the second through hole.

15 Claims, 16 Drawing Sheets

(56) References Cited

U.S. PATENT DOCUMENTS

| | | | | |
|---|---|---|---|---|
| 8,670,586 | B1 * | 3/2014 | Boyle | H04R 5/033 381/370 |
| 9,578,412 | B2 * | 2/2017 | Azmi | H04R 1/1016 |
| 10,034,086 | B2 * | 7/2018 | Sapiejewski | H04R 3/02 |
| 10,687,133 | B2 * | 6/2020 | Ozawa | H04R 1/1008 |
| 2009/0226023 | A1 | 9/2009 | Akino | |
| 2016/0142813 | A1 * | 5/2016 | Honda | H04R 1/1008 381/370 |
| 2019/0052948 | A1 * | 2/2019 | Kamimura | H04R 1/1016 |
| 2019/0116410 | A1 * | 4/2019 | Barrieau | H04R 1/1008 |

FOREIGN PATENT DOCUMENTS

| | | | |
|---|---|---|---|
| JP | 2017-513356 | A | 5/2017 |
| KR | 2011 0123935 | A | 11/2011 |

* cited by examiner

HEADPHONE

TECHNICAL FIELD

The present invention relates to a headphone.

BACKGROUND ART

For example, an over-ear type headphone (hereinafter referred to as "headphone") is used as an item for personal use to listen to music. Generally, a headphone includes a driver unit generating sound waves, a baffle plate holding the driver units, a housing accommodating the driver unit therein and defining a rear cavity, and an ear pad covering user's ears and defining a front cavity.

The characteristics of the headphone is determined based on a structural form (such as the type and/or the size of the driver units, and the shape and/or the size of the housings) of each member forming the headphone, the size and/or sealability of each of the rear cavity and the front cavity.

The sealability of the front cavity influences the characteristics in the low frequency range of the headphone. For example, low frequency sound has less directivity than those of medium-high frequency sound. Therefore, when the front cavity has low sealability, the low frequency sound is emitted from a gap to outside, and the level of the low frequency range decreases. In addition, when the front cavity is completely sealed, vibration of a diaphragm of the driver unit is damped by air pressure in the front cavity. In particular, when the diaphragm is vibrated at the low frequency range, the diaphragm is displaced while slowly moving the air. Specifically, the diaphragm pushes out more air to an air chamber as the frequency range becomes lower. At this stage, the pressure (hereinafter referred to as "back pressure") of the air in the air chamber changes, and the diaphragm receives reaction force from the air in the air chamber. For this reason, when the front cavity is completely sealed, vibration of the diaphragm is more strongly damped by back pressure as the frequency range becomes lower. As a result, in particular, generation of sound waves in the low frequency range is impeded (the low frequency sound is not emitted). Therefore, securing sealability of the front cavity with a degree not influencing low frequency range vibration of the diaphragm is required to secure the level of the low frequency range.

When the sealability of the front cavity is enhanced as described above, change in form of the ear pad is impeded due to air pressure in the front cavity when the headphone is worn on a user. Consequently, wearing comfort for the user of the headphone is deteriorated. In addition, when the headphone is dropped to close the ear pad, the air pressure in the front cavity rapidly increases, and a fault may be caused, such as deformation and breakage of the diaphragm.

A headphone adjusting the air pressure in a front cavity by causing the front cavity to communicate with an external space has been proposed (for example, see Published Japanese Translation of PCT Application No. 2017-513356).

The headphone disclosed in Published Japanese Translation of PCT Application No. 2017-513356 includes a tube-shaped pressure equalizer port extending in the front cavity. The front cavity communicates with the external space through the pressure equalizer port. The pressure equalizer port is formed to have a predetermined length and an effective cross-sectional area in accordance with the desired characteristics of the headphone. As a result, in the headphone disclosed in Published Japanese Translation of PCT Application No. 2017-513356, decrease in level of the low frequency range is suppressed, and the air pressure in the front cavity is equalized with the pressure of the external space.

However, in the headphone disclosed in Published Japanese Translation of PCT Application No. 2017-513356, the pressure equalizer port is inserted through a hole provided in a housing, and fixed with adhesive or the like. Therefore, the headphone has low productivity, and disposition of the pressure equalizer port is also limited (degree of freedom of arrangement is small). In addition, the pressure equalizer port is formed in accordance with the desired characteristics. Therefore, after the pressure equalizer port is fixed on the housing, fine adjustment of the characteristics of the headphone with the equalizer port is difficult.

SUMMARY OF INVENTION

Technical Problem

An object of the present invention is to provide a headphone in which air pressure in a front cavity can be released to an external space, and whose characteristics in low frequency range can be easily and finely adjusted.

Solution to Problem

The headphone according to the present invention includes: a driver unit that generates sound waves based on an electrical signal; a baffle member that holds the driver unit; a passage forming member that is attached to the baffle member and forms a vent passage with the baffle member; an ear pad that is attached to the baffle member and forms a first space with the baffle member; and a cover member that is attached to the baffle member and forms a second space with the baffle member. The baffle member includes: a first surface that faces the first space; a second surface that faces the second space; and a first through hole that communicates with an internal space of the vent passage. The passage forming member includes a second through hole that communicates with the internal space of the vent passage. The second space communicates with an external space of the cover member. The first space communicates with the second space through the first through hole, the vent passage, and the second through hole.

Advantageous Effects of Invention

According to the present invention, in the headphone, the air pressure in the front cavity can be released to the external space, and the characteristics in the low frequency range of the headphone can be easily and finely adjusted.

DESCRIPTION OF EMBODIMENTS

Headphone

Embodiments of a headphone according to the present invention will now be described with reference to the attached drawings.

Configuration of Headphone

Figure 1:
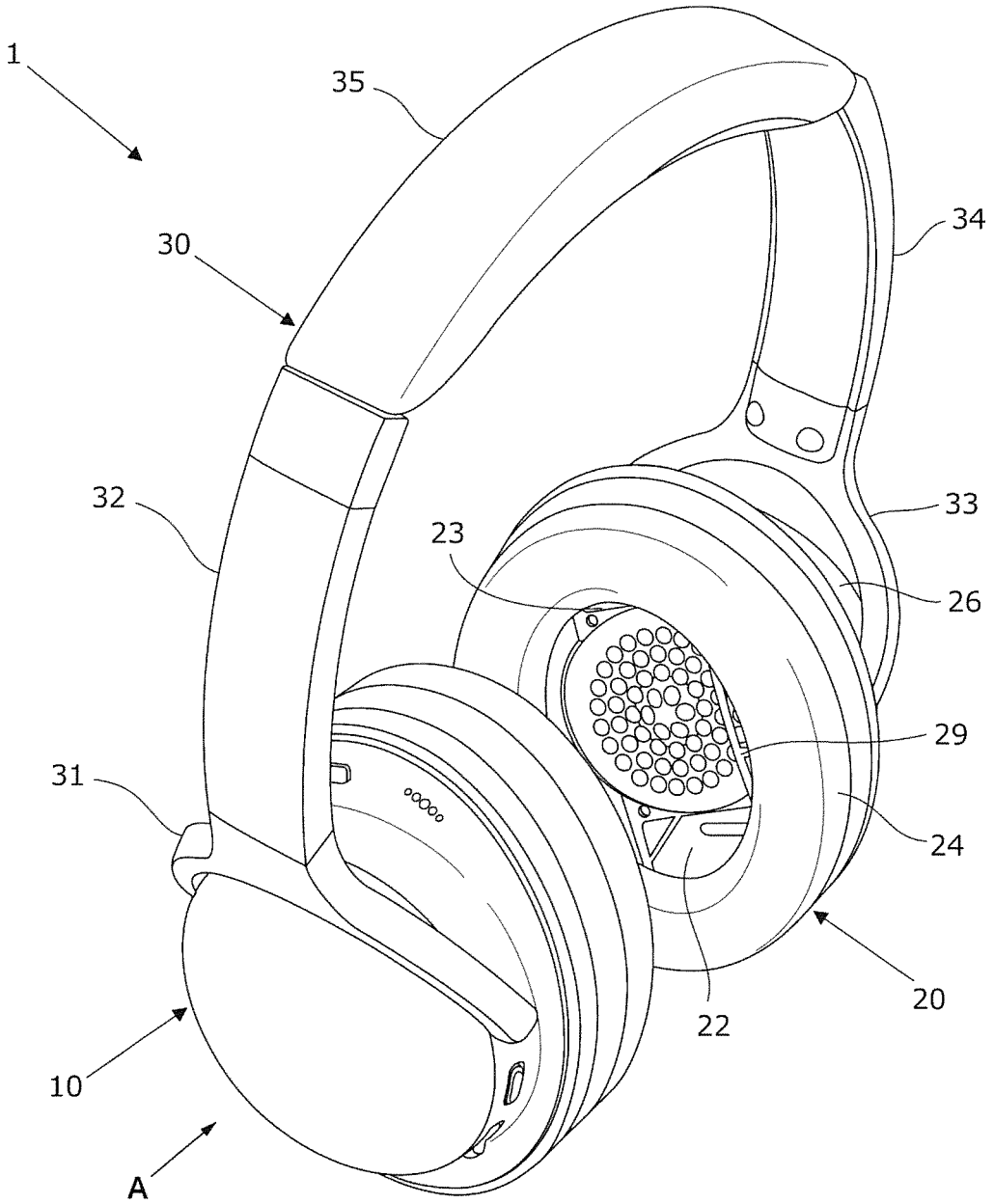
FIG. 1 is a perspective view illustrating an embodiment of a headphone according to the present invention.

FIG. 1 is a perspective view illustrating an embodiment of the headphone according to the present invention.

A headphone 1 is worn on a head of a user of the headphone 1, and outputs sound waves in accordance with sound signals from a sound source (not illustrated), such as a portable music player, to the user's ears. The headphone 1 includes a left sound emission unit 10, a right sound emission unit 20, and a connection member 30. The left sound emission unit 10 and the right sound emission unit 20 constitute a pair of sound emission units.

Figure 2:
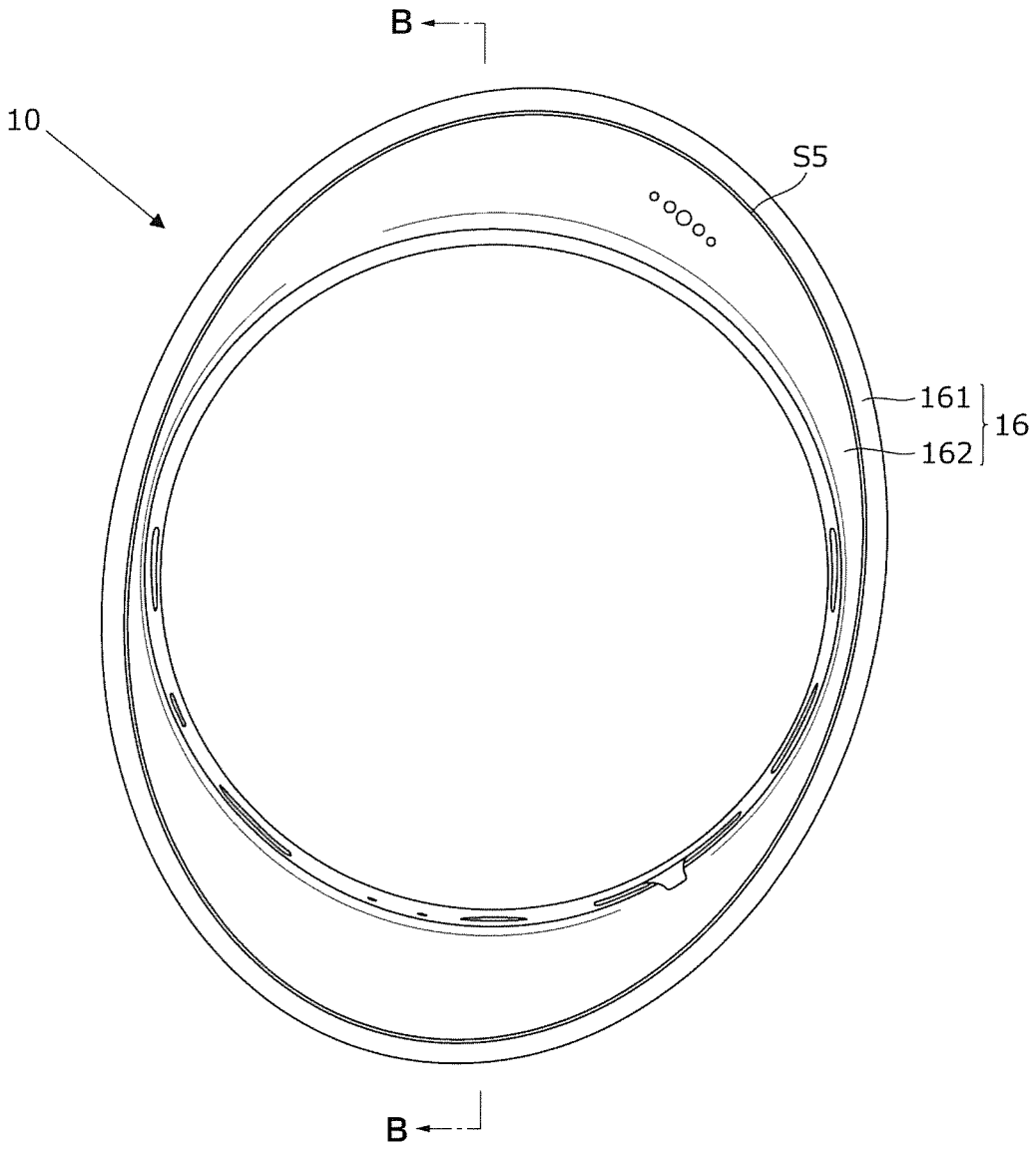
FIG. 2 is a diagram of a left sound emission unit included in the headphone of FIG. 1 viewed along arrow A.

FIG. 2 is a diagram of the left sound emission unit 10 of FIG. 1 viewed along an arrow A.

The left sound emission unit 10 is worn on a part around the left ear of the user, and outputs sound waves in accordance with sound signals from the sound source.

Figure 3:
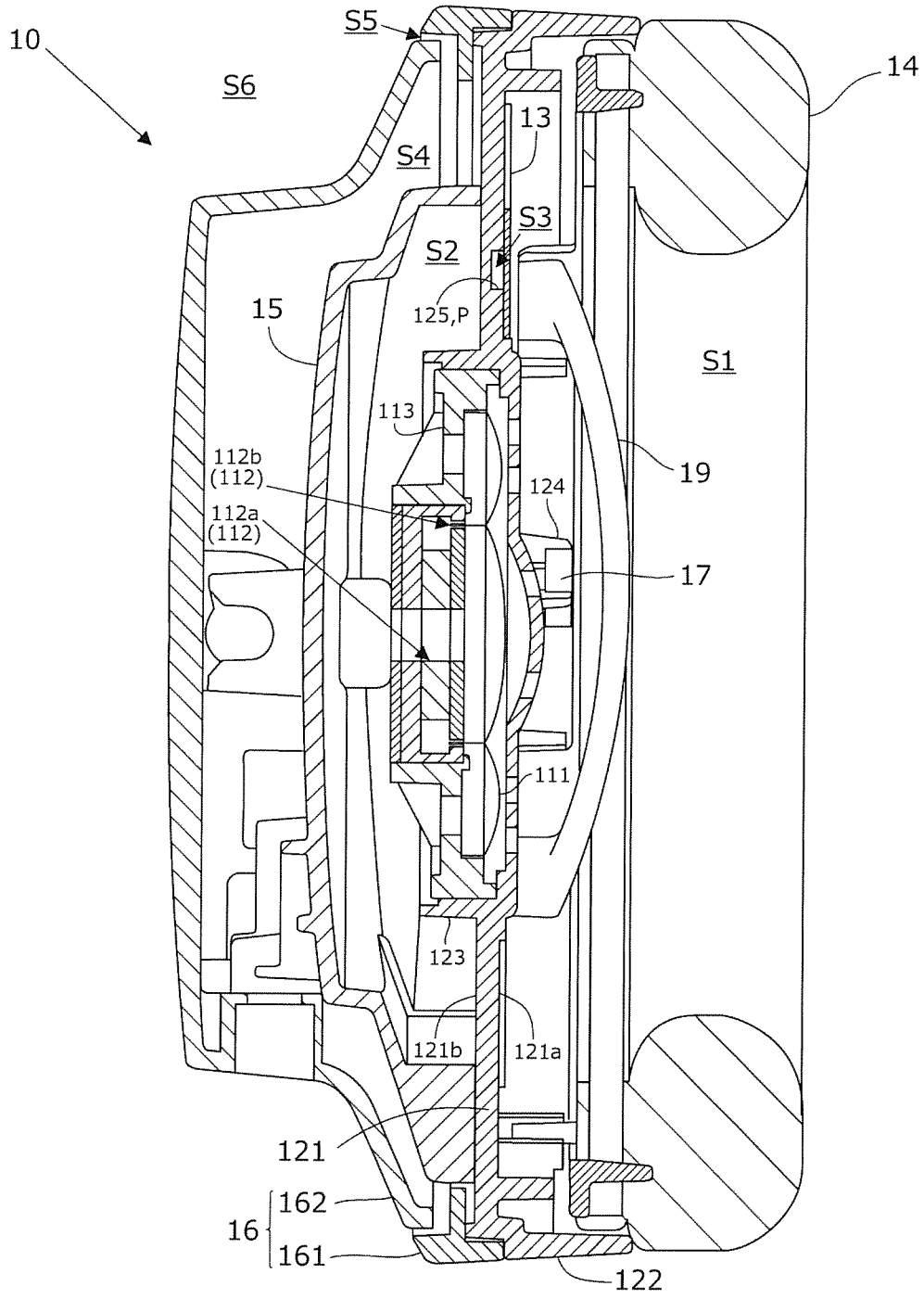
FIG. 3 is a cross-sectional view of the left sound emission unit of FIG. 2, taken along line B-B.

FIG. 3 is a cross-sectional view of the left sound emission unit 10 of FIG. 2 taken along line B-B.

Figure 4:
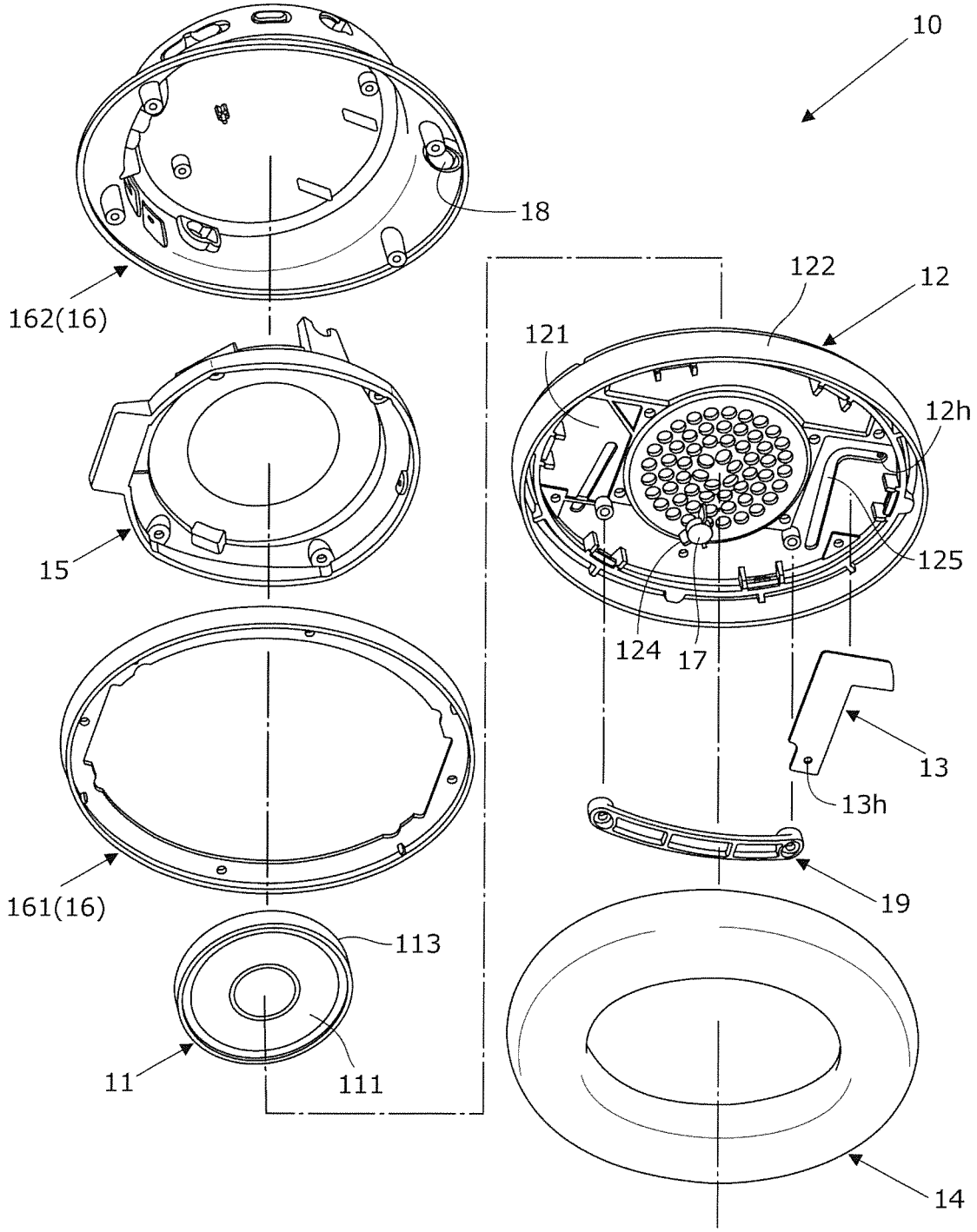
FIG. 4 is an exploded perspective view of the left sound emission unit of FIG. 2.

FIG. 4 is an exploded perspective view of the left sound emission unit 10.

In FIG. 3, illustration of some lines is omitted, for the sake of convenience of explanation.

In the following explanation, the "front direction" means a direction (the right direction in FIG. 3) toward the head side of the user in the state in which the headphone 1 is worn on the head of the user. The "rear direction" means a direction (the left direction in FIG. 3) opposite to the front direction.

The left sound emission unit 10 includes a driver unit 11, a baffle member 12, a passage forming member 13, an ear pad 14, a housing 15, a cover member 16, a first microphone 17, a second microphone 18, and a microphone cover 19.

The driver unit 11 generates sound waves based on electrical signals from the sound source, and outputs the sound waves. The driver unit 11 is, for example, a dynamic-type driver unit. The driver unit 11 is held by the below-mentioned unit holding part 123. The driver unit 11 includes a diaphragm 111, a drive part 112, and a frame 113.

The diaphragm 111 vibrates based on driving (vibration) of the drive part 112, and outputs sound waves.

The drive part 112 is driven (vibrated) by electromagnetic induction based on the electrical signal, and vibrates the diaphragm 111. The drive part 112 includes a magnetic circuit 112*a* and a voice coil 112*b*. The voice coil 112*b* is disposed in a magnetic gap of the magnetic circuit 112*a*, and attached to a rear surface of the diaphragm 111.

The frame 113 holds the diaphragm 111 and the drive part 112. The frame 113 has a shape of a hat. The diaphragm 111 is attached to a front surface of the frame 113. The drive part 112 is accommodated in the frame 113.

The baffle member 12 holds the driver unit 11. The baffle member is, for example, composed of a synthetic resin, such as acrylonitrile-butadiene-styrene (ABS) resin. The baffle member 12 has an oval shape in front view. The baffle member 12 includes a plate-shaped part 121, a circumferential wall part 122, a unit holding part 123, a microphone holder part 124, a groove 125, and a through hole 12*h*.

The plate-shaped part 121 defines a front cavity S1, a rear cavity S2, and an inner cover space S4, which are described later. The plate-shaped part 121 separates the front cavity S1, the rear cavity S2, and the inner cover space S4. The plate-shaped part 121 has an oval plate shape, and includes a front surface 121*a* and a rear surface 121*b*. The front surface 121*a* is the first surface in the present invention, and the rear surface 121*b* is the second surface in the present invention.

The circumferential wall part 122 defines the below-mentioned front cavity S1. The circumferential wall part 122 extends in the front direction in an annular shape from an outer edge of the front surface 121*a* of the plate-shaped part 121.

Figure 5:
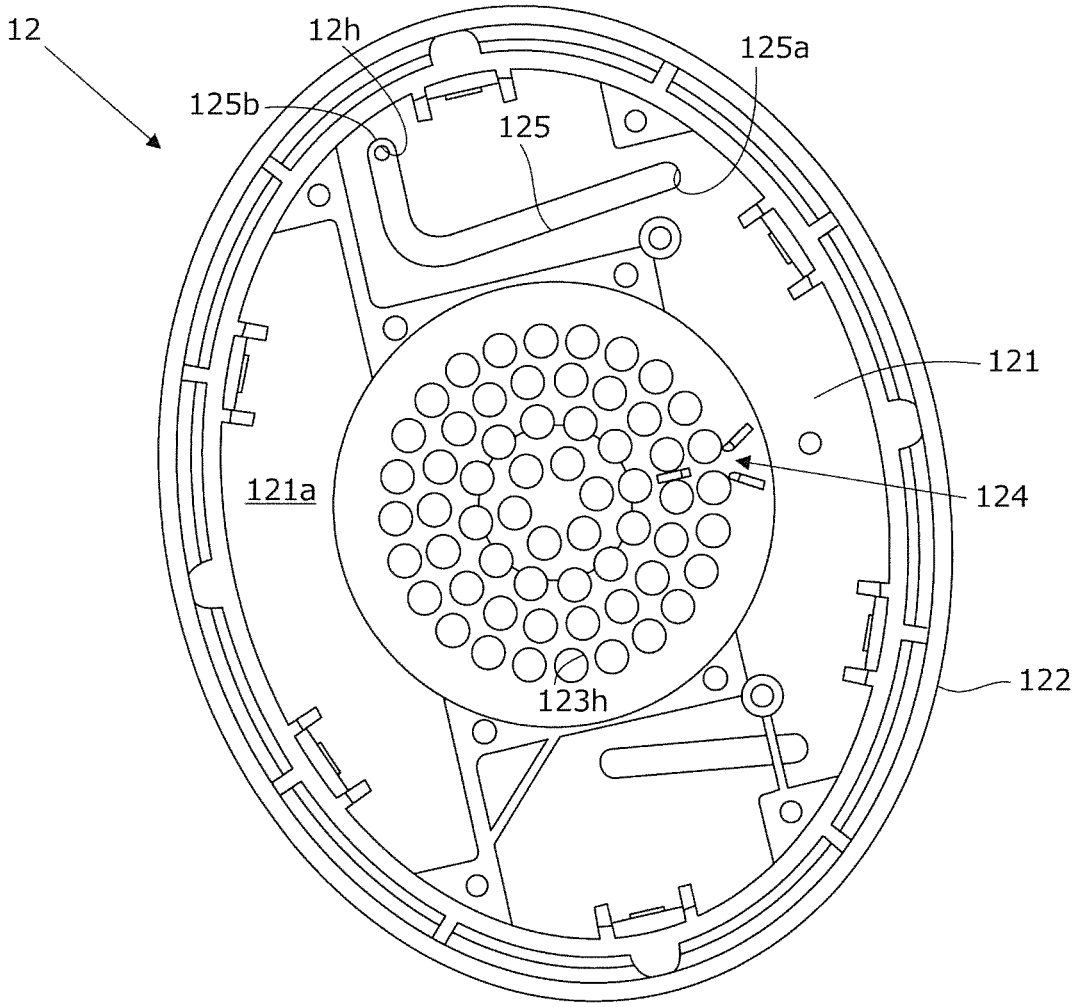
FIG. 5 is a front view of a baffle member included in the left sound emission unit of FIG. 2.

FIG. 5 is a front view of the baffle member 12.

Figure 6:
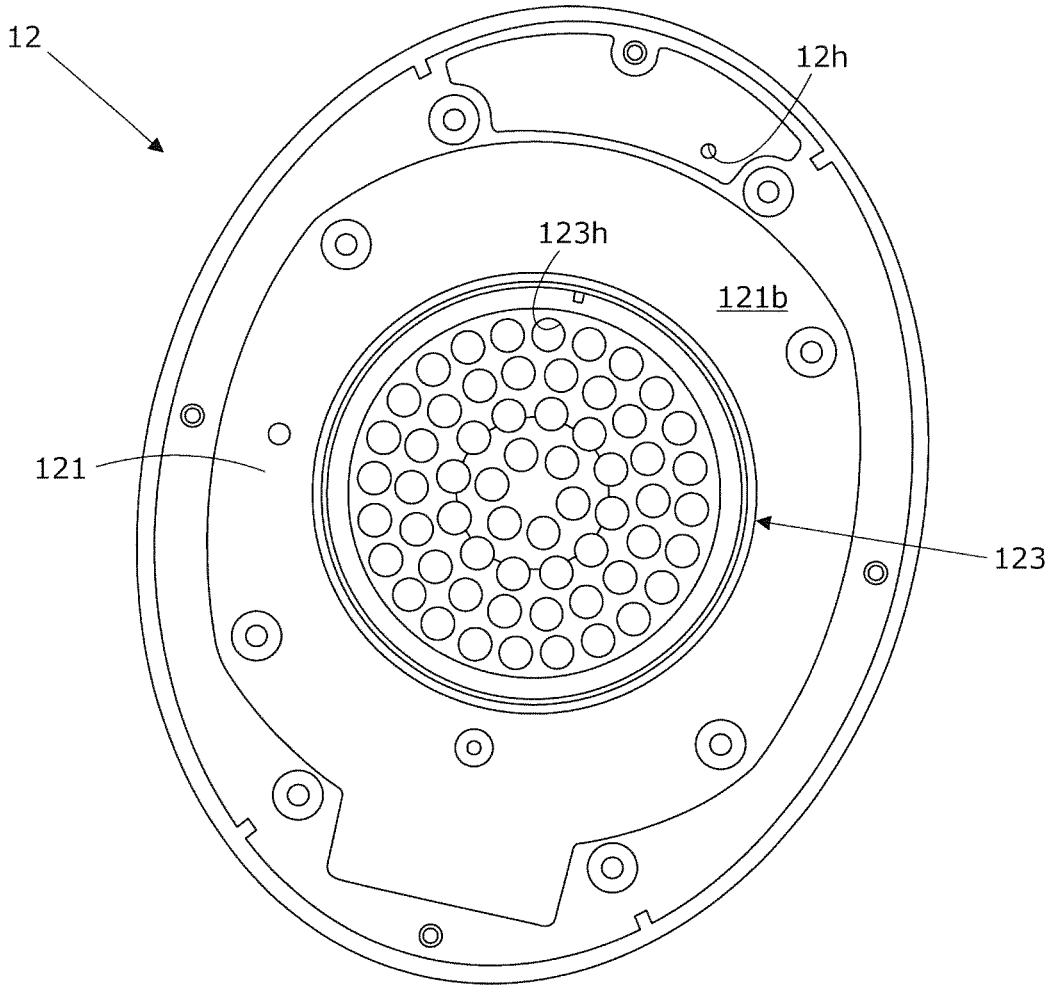
FIG. 6 is a back view of the baffle member of FIG. 5.

FIG. 6 is a back view of the baffle member 12.

The unit holding part 123 holds the driver unit 11 (see FIG. 4). The unit holding part 123 is disposed in the center of the rear surface 121*b* of the plate-shaped part 121. The unit holding part 123 includes a plurality of sound holes 123*h* through which sound waves from the driver unit 11 pass.

The microphone holder part 124 holds the first microphone 17 (see FIG. 4). The microphone holder part 124 is disposed on the front surface 121*a* (in front of the unit holding part 123) of the plate-shaped part 121.

The groove 125 forms a vent passage P (refer to FIG. 3) with the passage forming member 13 (refer to FIG. 4). The groove 125 is a long groove having a substantially L shape in front view and a rectangular shape in cross-sectional view. The groove 125 is disposed in the front surface 121*a* of the plate-shaped part 121. The groove 125 includes a first end 125*a* and a second end 125*b* as both longitudinal ends, each of which has a semicircular shape in front view. The second end 125*b* is "one end" of the groove in the present invention. The first end 125*a* is "another end" of the groove in the present invention. The depth of the groove 125 is constant from the first end 125*a* to the second end 125*b*. The width of the groove 125 is fixed from the first end 125*a* side to the second end 125*b* side, except both of the ends 125*a* and 125*b*. The vent passage P will be described later.

The groove 125 can be disposed in a desired position in the front surface 121*a* of the baffle member 12, as long as the position is a position that the groove 125 can be covered with the passage forming member 13, as described later. Each of the length and the width of the groove 125 is settable as desired in accordance with the characteristics in the low frequency range of the headphone 1. In addition, both ends of the groove are not limited to a semicircular shape, but can be formed in any shape (such as a rectangular shape).

The through hole 12*h* penetrates through the front surface 121*a* and the rear surface 121*b* of the plate-shaped part 121 and establishes communication between the below-mentioned internal space (hereinafter referred to as "inner passage space") S3 (refer to FIG. 3) of the vent passage P (see FIG. 3) and the inner cover space S4 (see FIG. 3). The through hole 12*h* has a space communicating with each of the inner passage space S3 and the inner cover space S4. In other words, the through hole 12*h* communicates with each of the inner passage space S3 and the inner cover space S4. The through hole 12*h* is the first through hole in the present invention. The through hole 12*h* is disposed at the second end 125*b* of the groove 125. The "disposed at the second end 125*b*" means that the through hole 12*h* is disposed, for example, in any position separated from the second end 125*b* by a space within a diameter of the through hole 12*h*. The through hole 12*h* is opened in a position facing a back surface (surface opposite to the sound collection surface) of the second microphone 18 (see FIG. 4), in the inner cover space S4.

The through hole 12*h* can be disposed in a desired position of the baffle member 12, as long as the through hole 12*h* communicates with the inner cover space S4 (refer to FIG. 3).

It should be noted that the through hole is disposed on the second end side in both ends of the groove. Specifically, for example, the through hole may be disposed in a position distant from the second end of the groove. Further, the through hole may be formed in any shape (such as a circular shape and a rectangular shape).

Referring back to FIG. 3 and FIG. 4, the passage forming member 13 forms the vent passage P with the groove 125 of the baffle member 12. The passage forming member 13 is, for example, composed of a synthetic resin, such as polyethylene terephthalate (PET) resin. The passage forming member 13 has a substantially L shape in front view. The passage forming member 13 has a shape of a flat plate having a front surface and a rear surface parallel to each other. The passage forming member 13 includes a through hole 13*h*. The passage forming member 13 is attached to the front surface 121*a* of the plate-shaped part 121 to cover the groove 125. As a result, the vent passage P is formed with the groove 125 and the passage forming member 13 between the baffle member 12 and the passage forming member 13.

It should be noted that the passage forming member can be formed in any shape (such as a rectangular shape), as long as the shape is a shape covering the groove.

The through hole 13*h* establishes communication between the below-mentioned front cavity S1 and the inner passage space S3. Specifically, the through hole 13*h* has a space communicating with each of the front cavity S1 and the inner passage space S3. The through hole 13*h* is the second through hole in the present invention that communicates with each of the front cavity S1 and the vent passage P. The through hole 13*h* is disposed in a position facing (opposed to) the first end 125*a* (the bottom surface of) (see FIG. 5) of the groove 125 in front view. In other words, the through hole 13*h* is disposed near the first end 125*a* side of the groove 125 rather than the through hole 12*h*. The "position facing the first end 125*a*" means a position facing, for example, a desired position separated from the first end 125*a* by a space within a diameter of the through hole 13*h*, in the bottom surface of the groove 125.

It should be noted that, in the passage forming member, the through hole is disposed in a position facing the first end side in both ends of the groove. Specifically, for example, the through hole may be disposed in a position distant from the first end of the groove. Further, the through hole may be formed in any shape (such as a circular shape and a rectangular shape).

The ear pad 14 defines the front cavity S1 with the baffle member 12. The ear pad 14 also functions as a buffer of the headphone 1 for the head of the user. The ear pad 14 has an oval ring shape. The ear pad 14 is attached to the circumferential wall part 122 of the baffle member 12.

The front cavity S1 is a space surrounded by the head of the user, the baffle member 12, and the ear pad 14 when the headphone 1 is worn on the user. The front cavity S1 is the first space in the present invention. The front cavity S1 is disposed in front of the driver unit 11. The front surface 121*a* of the baffle member 12 faces the front cavity S1. As described above, the front cavity S1 communicates with the inner passage space S3 through the internal space of the through hole 13*h* of the passage forming member 13.

The housing 15 accommodates the driver unit 11, and defines the rear cavity S2 with the driver unit 11 and the baffle member 12. The housing 15 is, for example, composed of a synthetic resin, such as ABS resin. The housing 15 has a shape of a cup. The housing 15 is attached to the rear surface 121*b* of the baffle member 12.

The rear cavity S2 is a space surrounded by the driver unit 11, the baffle member 12, and the housing 15. The rear cavity S2 is the third space in the present invention. The rear cavity S2 functions as an acoustic impedance controlling sound pressure of sound waves that have reached the rear cavity S2. The rear cavity S2 is disposed in the rear of the driver unit 11. The rear surface 121*b* of the baffle member 12 faces the rear cavity S2.

The cover member 16 protects the housing 15 and the second microphone 18. The cover member 16 is, for example, composed of a synthetic resin, such as ABS resin. The cover member 16 includes a first cover member 161 and a second cover member 162.

The first cover member 161 has an oval ring shape. The first cover member 161 is attached to an outer edge of the rear surface 121*b* of the baffle member 12. The second cover member 162 has a shape of a cup. As illustrated in FIG. 2, the second cover member 162 is disposed inside the first cover member 161 spaced from a gap S5 in rear view.

The gap S5 is a space establishing communication between the space (hereinafter referred to as "inner cover space") S4 inside the cover member 16 and a space (hereinafter referred to as "external space") S6 outside the cover member 16. As illustrated in FIG. 2, the gap S5 is disposed between the first cover member 161 and the second cover member 162 and over the entire circumference of the cover member 16. In other words, the cover member 16 includes the gap S5.

The inner cover space S4 is a space surrounded by the baffle member 12, the housing 15, and the cover member 16. The inner cover space S4 is the second space in the present invention. The rear surface 121*b* of the baffle member 12 faces the inner cover space S4. As described above, the inner cover space S4 communicates with the inner passage space S3 through the internal space of the through hole 12*h* of the baffle member 12, and communicates with the external space S6 through the gap S5 of the cover member 16.

The first microphone 17 collects sound waves in the front cavity S1. The first microphone 17 is held by the microphone holding part 124 of the baffle member 12. The second microphone 18 collects sound waves that have reached the cover member 16 from the external space S6. The second microphone 18 is accommodated in the second cover member 162.

Specifically, the headphone 1 is a hybrid-type noise-cancelling headphone that cancels noise based on the sound collection results of the two microphones 17 and 18.

The microphone cover 19 protects the first microphone 17 from, for example, the user's fingers. The microphone cover 19 is attached to the front surface 121*a* of the baffler member 12 to cover the first microphone 17.

Referring back to FIG. 1, the configuration of the right sound emission unit 20 is in common with the configuration of the left sound emission unit 10. Specifically, the right sound emission unit 20 includes a driver unit, a baffle member 22, a passage forming member 23, an ear pad 24, a housing, a cover member 26, a first microphone, a second microphone, and a microphone cover 29.

The connection member 30 connects the left sound emission unit 10 with the right sound emission unit 20, and provides side pressure on the head of the user when the headphone 1 is worn on the user. The connection member 30 includes a left arm 31, a left slider 32, a right arm 33, a right slider 34, and a head band 35.

The left arm 31 supports the left sound emission unit 10 in a state where the left sound emission unit 10 is swingable. The left slider 32 adjusts the position (length from the left sound emission unit 10 to the head band 35) of the left sound emission unit 10. The right arm 33 supports the right sound emission unit 20 in a state where the right sound emission unit 20 is swingable. The right slider 34 adjusts the position (length from the right sound emission unit 20 to the head band 35) of the right sound emission unit 20. The head band 35 applies force (side pressure) in a direction in which the left sound emission unit 10 and the right sound emission unit 20 approach each other.

Configuration of Vent Passage

The configuration of the vent passage P will now be described.

Figure 7:
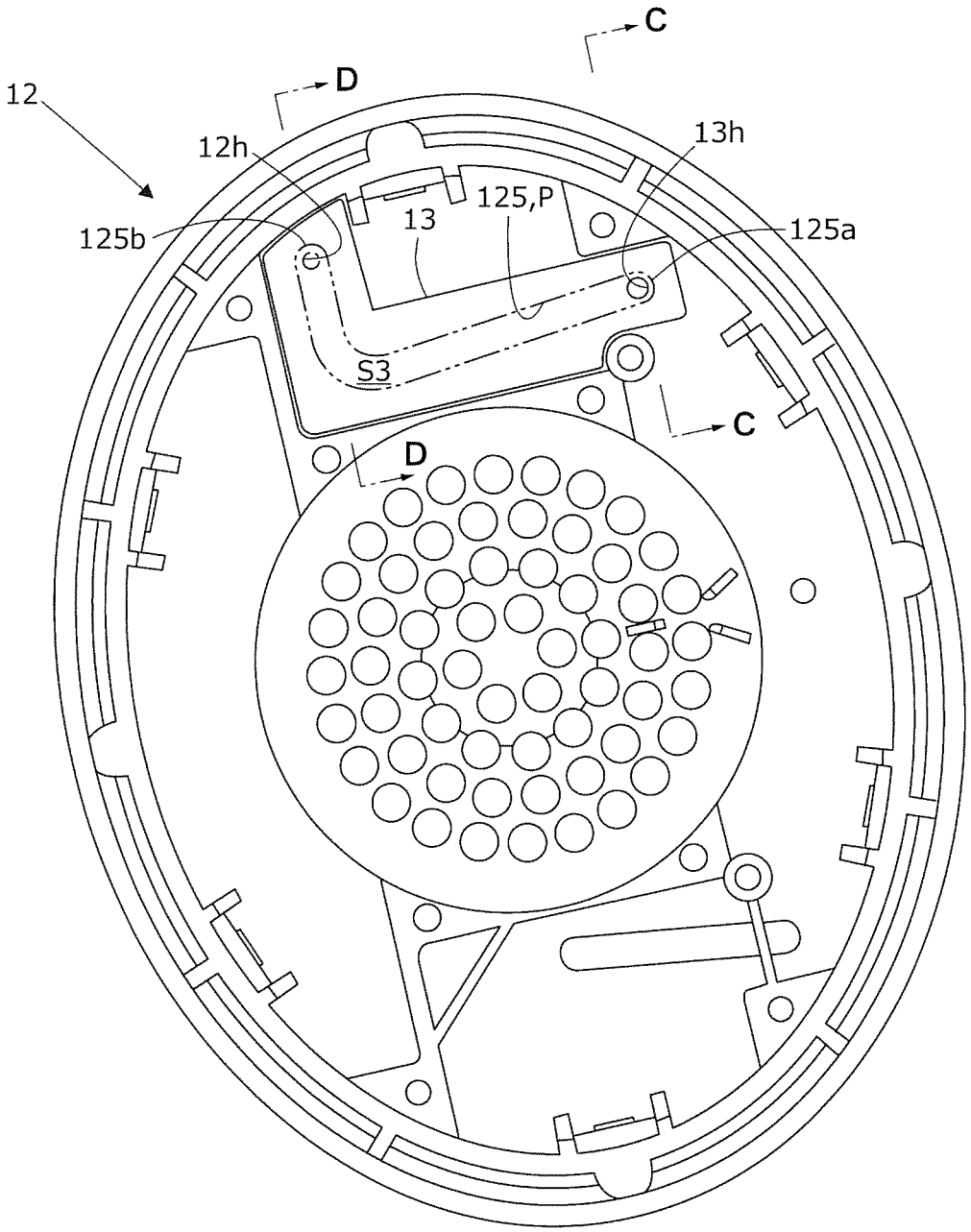
FIG. 7 is a front view of the baffle member of FIG. 5 to which a passage forming member included in the left sound emission unit of FIG. 2 is attached.

FIG. 7 is a front view of the baffle member 12 to which the passage forming member 13 is attached.

FIG. 7 illustrates the vent passage P and the through hole 12*h* disposed on the back surface of the passage forming member 13 with two dot chain lines.

As described above, the vent passage P is a substantially tube-shaped passage formed with the groove 125 and the passage forming member 13 when the groove 125 of the baffle member 12 is covered with the passage forming member 13. Specifically, the shape of the vent passage P is in common with the shape of the groove 125. In other words, the vent passage P has a substantially L shape in front view.

Figure 8:
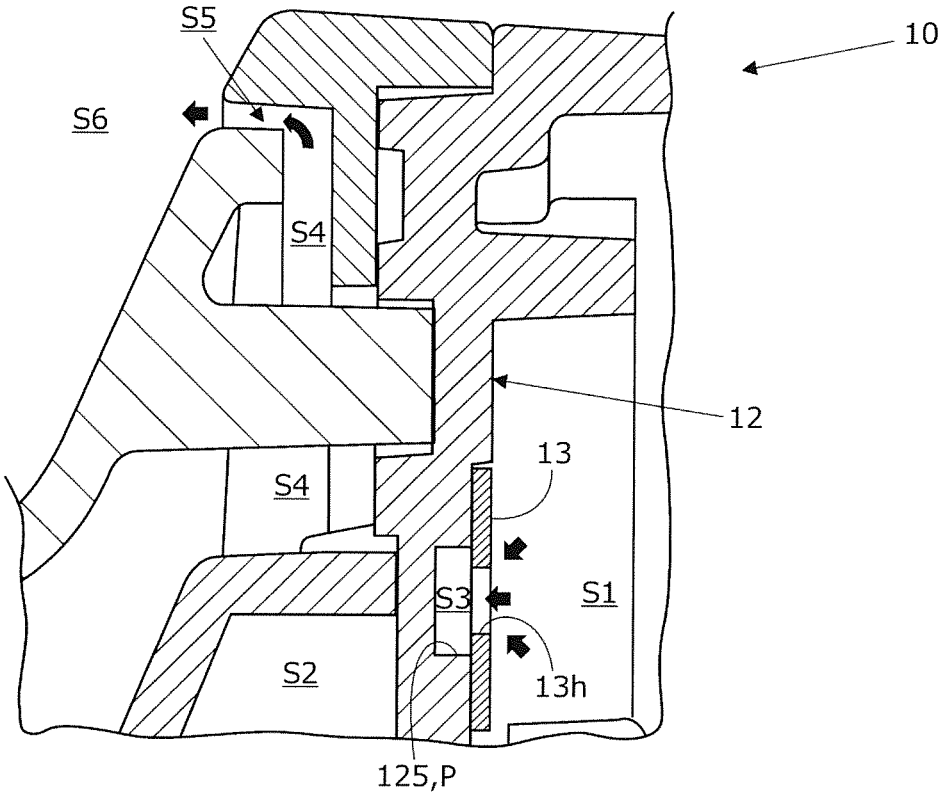
FIG. 8 is a partial enlarged cross-sectional view of the left sound emission unit of FIG. 2 taken along line C-C of FIG. 7.

FIG. 8 is a partial enlarged cross-sectional view of the left sound emission unit 10 taken along line C-C of FIG. 7.

Figure 9:
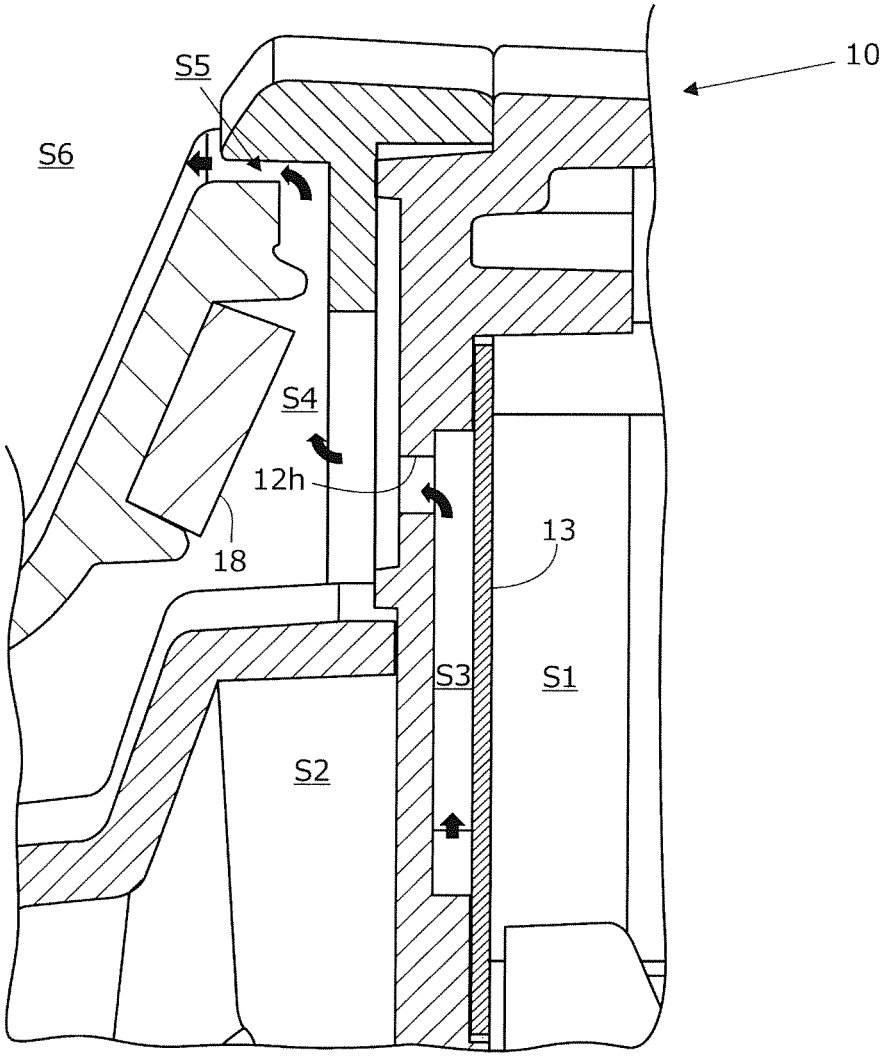
FIG. 9 is a partial enlarged cross-sectional view of the left sound emission unit of FIG. 2 taken along line D-D of FIG. 7.

FIG. 9 is a partial enlarged cross-sectional view of the left sound emission unit 10 taken along line D-D of FIG. 7.

Each of FIG. 8 and FIG. 9 illustrates flow of the air from the below-described front cavity S1 with black arrows.

The vent passage P is a rectangular passage in a cross-sectional view (cross section obtained by cutting the vent passage P along the transverse direction of the vent passage P) of the vent passage P. The diameter of the through hole 12*h* is smaller than the diameter of the through hole 13*h*. The cross-sectional area of the vent passage P is larger than each of the opening area of the through hole 12*h* and the opening area of the through hole 13*h*.

It should be noted that, the diameter of the through hole of the baffle member may be the same as the diameter of the through hole of the passage forming member, or larger than the diameter of the through hole of the passage forming member. In addition, the cross-sectional area of the vent passage may be the same as the opening areas of the two through holes.

As described above, the inner passage space S3 communicates with the front cavity S1 through the internal space of the through hole 13*h*. In addition, the inner passage space S3 communicates with the inner cover space S4 through the internal space of the through hole 12*h*. In addition, the inner cover space S4 communicates with the external space S6 through the gap S5 of the cover member 16. Specifically, the air in the front cavity S1 can flow (move) to the inner passage space S3 through the through hole 13*h*. The air in the inner passage space S3 can flow into the inner cover space S4 through the through hole 12*h*. The air in the inner cover space S4 can flow into the external space S6 through the gap S5.

When the air pressure in the front cavity S1 increases at the time when the headphone 1 is worn on the user or dropped, the air pressure in the front cavity S1 can be released (transmitted) to the external space S6 through the internal space of the through hole 13*h*, the inner passage space S3, the internal space of the through hole 12*h*, the inner cover space S4, and the gap S5. Specifically, the vent passage P functions as a vent port releasing the air pressure in the front cavity S1 to the external space S6 (moves the air in the front cavity S1 to the external space S6). Therefore, the length and/or the cross-sectional area of the vent passage P influences the characteristics in the low frequency range of the headphone 1.

The length of the vent passage P influences the resonance frequency of the headphone 1. Specifically, for example, when the cross-sectional area of the vent passage P is fixed, the resonance frequency of the headphone 1 decreases when the length of the vent passage P increases, and increases when the length of the vent passage P decreases. As a result, the cutoff frequency at the low frequency range of the headphone 1 decreases when the length of the vent passage P increases, and the cutoff frequency at the low frequency range of the headphone 1 increases when the length of the vent passage P decreases.

By contrast, the cross-sectional area of the vent passage P influences the volume of the air in the inner passage space S3 moved by the diaphragm 111 by each one amplitude. Specifically, for example, when the length of the vent passage P is fixed, the volume decreases when the cross-sectional area of the vent passage P decreases, and the volume increases when the cross-sectional area of the vent passage P increases. In this configuration, when the diaphragm 111 pushes out the air into the front cavity S1, the air in the front cavity S1 moves to the inner passage space S3, the air in the inner passage space S3 moves to the inner cover space S4, and the air in the inner cover space S4 moves to the external space S6. However, when cross-sectional area of the vent passage P decreases, the air in the front cavity S1 becomes hard to move to the inner passage space S3, and the air pressure in the front cavity S1 increases. The diaphragm 111 pushes out more air to the front cavity S1 as the frequency range becomes lower.

Therefore, the diaphragm 111 is more strongly damped by the air pressure in the front cavity S1 as the frequency range becomes lower. As a result, decrease in level of the low frequency range of the headphone 1 is suppressed when the cross-sectional area of the vent passage P decreases, and decrease in level of the low frequency range of the headphone 1 is promoted when the cross-sectional area of the vent passage P increases.

The length of the vent passage P is substantially shortened by changing the position of the through hole 13*h* of the passage forming member 13 to the second end 125*b* side of the groove 125. As a result, the characteristics in the low frequency range of the headphone 1 can be easily and finely adjusted by changing the position (disposition) of the through hole 13*h*.

Figure 10:
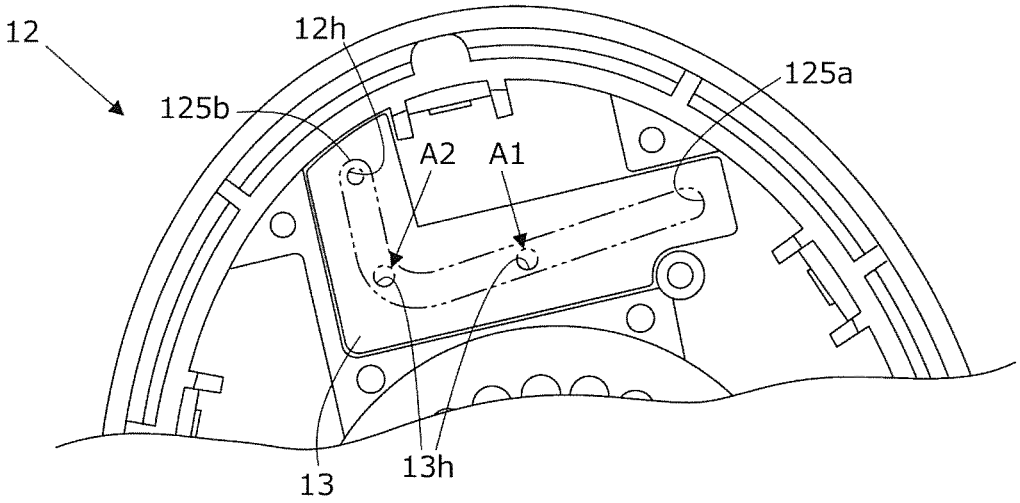
FIG. 10 is a partial enlarged view illustrating an example of changing disposition of a through hole included in the passage forming member of FIG. 7.

FIG. 10 is a partial enlarged view illustrating an example of the vent passage P in which position of the through hole 13*h* of the passage forming member 13 is changed.

In FIG. 10, positions A1 and A2 illustrated with two dot chain lines illustrates positions where the through hole 13*h* is disposed.

When the through hole 13*h* is disposed in the position A1, the internal air of the vent passage P from the position A1 to the first end 125*a* is harder to flow (the air is hard to move) than the internal air of the vent passage P from the position A1 to the second end 125*b*. Therefore, when the through hole 13*h* is disposed in the position A1, the substantial length of the vent passage P is a length from the position A1 to the second end 125*b*. In the same manner, when the through hole 13*h* is disposed in the position A2, the substantial length of the vent passage P is a length from the position A2 to the second end 125*b*. In this configuration, the substantial length of the vent passage P when the through hole 13*h* is disposed in the position A1 is longer than the substantial length of the vent passage P when the through hole 13*h* is disposed in the position A2.

Figure 11:
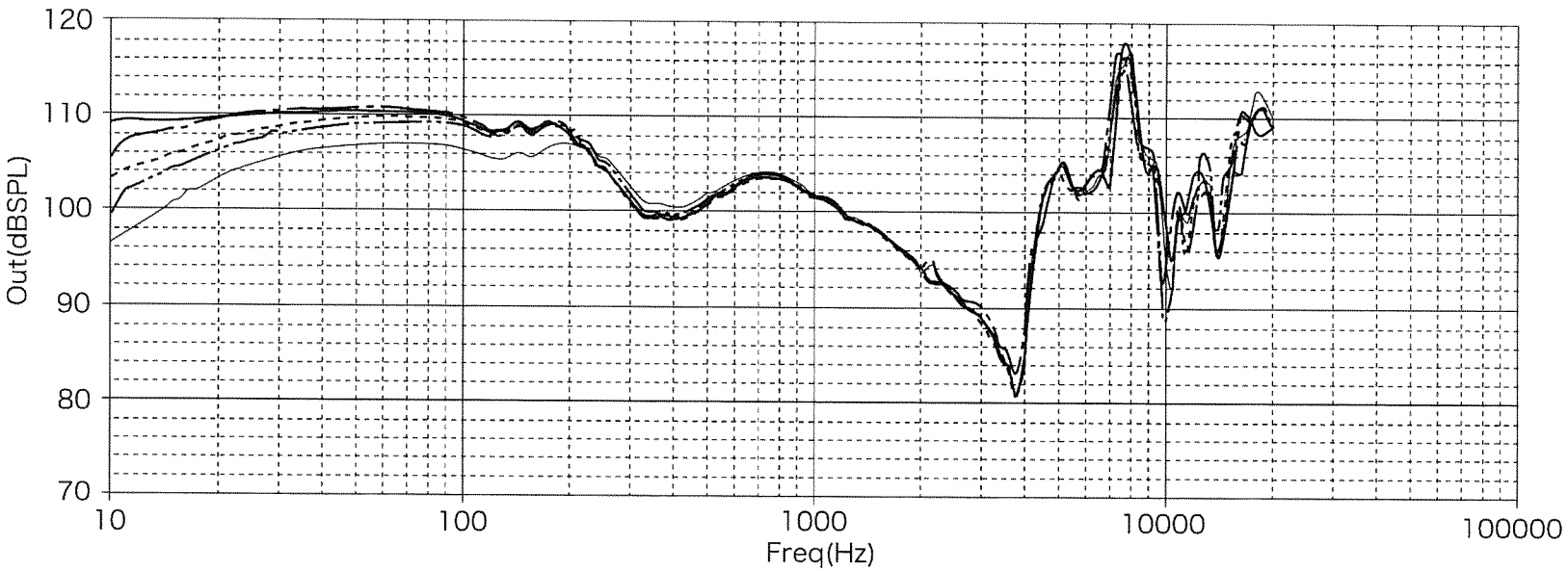
FIG. 11 is a frequency characteristic diagram of the headphone in a case of changing disposition of the through hole included in the passage forming member of FIG. 7.

FIG. 11 is a frequency characteristic diagram of the headphone 1 in the cases where the through hole 13*h* of the passage forming member 13 is disposed in the position facing the first end 125*a*, the position A1, and the position A2 in FIG. 10.

FIG. 11 illustrates the characteristic in the case where the through hole 13*h* is disposed in a position facing the first end 125*a* with a dashed line. FIG. 11 illustrates the characteristic in the case where the through hole 13*h* is disposed in the position A1 with a broken line. FIG. 11 illustrates the characteristic in the case where the through hole 13*h* is disposed in the position A2 with a two dot chain line. FIG. 11 illustrates the characteristic in the state (hereinafter referred to as "hole communication state") in which only the through hole 12*h* establishes communication between the front cavity S1 and the inner cover space S4 with a solid line. FIG. 11 illustrates the characteristic in the case (hereinafter referred to as "sealed state") in which the front cavity S1 does not communicate with the inner cover space S4 with a bold solid line.

Decrease in level of the low frequency range in the cases (illustrated with the dashed line, the broken line, and the two dot chain line in FIG. 11) where the communication between the front cavity S1 and the inner cover space S4 is established through the vent passage P is more suppressed than decrease in level of the low frequency range in the hole communication state (illustrated with the solid line in FIG. 11). In addition, the level of the low frequency range in the case where (illustrated with the dashed line in FIG. 11) when the through hole 13*h* is disposed in the position facing the first end 125*a* is close to the level of the low frequency range in the sealed state (illustrated with the bold solid line in FIG. 11). Specifically, when the through hole 13*h* is disposed in the position facing the first end 125*a*, decrease in level of the low frequency range is suppressed to the minimum.

As described above, when the through hole 13*h* is disposed on the second end 125*b* side (positions A1 and A2) from the position facing the first end 125*a*, the substantial length of the vent passage P is shortened. As a result, the cutoff frequency of the low frequency range of the headphone 1 increases as position of the through hole 13*h* becomes close to the second end 125*b* (as the substantial length of the vent passage P is shortened). Specifically, the characteristics in the low frequency range of the headphone 1 can be easily and finely adjusted by only changing the position of the through hole 13*h* in the headphone 1 (for example, attaching the passage forming member 13 including the through hole 13*h* having a different position to the baffle member 12).

It should be noted that, as described above, the configuration of the right sound emission unit is in common with the configuration of the left sound emission unit. Therefore, also in the right sound emission unit, the front cavity communicates with the inner cover space through the through hole of the passage forming member, the vent passage, and the through hole of the baffle member. In addition, the inner cover space communicates with the external space through the gap of the cover member. Specifically, the air in the front cavity can flow into the inner passage space through the through hole of the passage forming member. The air in the inner passage space can flow into the inner cover space through the through hole of the baffle member. The air in the inner cover space can flow into the external space through the gap. Specifically, the air pressure in the front cavity can be released (transmitted) to the external space through the internal space of the through hole of the passage forming member, the inner passage space, the internal space of the through hole of the baffle member, the inner cover space, and the gap.

CONCLUSION

According to the embodiment described above, the front cavity S1 communicates with the inner cover space S4 through the through hole 12*h* of the baffle member 12, the vent passage P, and the through hole 13*h*. The vent passage P is formed with the groove 125 of the baffle member 12 and the passage forming member 13. Specifically, the vent passage P establishing communication between the front cavity S1 and the inner cover space S4 is formed only with the baffle member 12 and the passage forming member 13. Specifically, the configuration of the vent passage P in the headphone 1 is simpler than the configuration of a conventional headphone (hereinafter referred to as "conventional headphone") in which a tube-shaped vent port is inserted through the housing. Accordingly, the productivity of the headphone 1 is high in comparison with that of the conventional headphone.

In addition, according to the embodiment described above, the through hole 13*h* establishing communication between the front cavity S1 and the inner passage space S3 is disposed in the passage forming member 13. By contrast, the through hole 12*h* establishing communication between the inner passage space S3 and the inner cover space S4 is disposed in the groove 125 of the baffle member 12. Therefore, the substantial length of the vent passage P can be easily changed by only changing position of the through hole 12*h* and/or the through hole 13*h* with respect to the groove 125. Specifically, the characteristics in the low frequency range of the headphone 1 can be easily and finely adjusted.

As described above, in the headphone 1 according to the present embodiment, the air pressure in the front cavity S1 can be released to the external space S6, and the characteristics in the low frequency range of the headphone 1 can be easily and finely adjusted, with a simple configuration in comparison with the conventional headphone.

In addition, according to the embodiment described above, the vent passage P is formed with a simple configuration of covering the groove 125 of the baffle member 12 with the passage forming member 13. The groove 125 may be disposed in any of the front surface 121*a* of the baffle member 12, as long as the through hole 12*h* communicates with the inner passage space S3. In addition, each of the length and the width of the groove 125 is settable as desired according to the characteristics in the low frequency range of the headphone 1. In other words, the position and/or the shape of the vent passage P are settable as desired within the range in which the vent passage P can be formed with the baffle member 12 and the passage forming member 13. Specifically, in the headphone 1 according to the present embodiment, the air pressure in the front cavity S1 can be released to the external space S6, and the characteristics in the low frequency range of the headphone 1 can be easily and finely adjusted, with a simple configuration in comparison with the conventional headphone.

In addition, according to the embodiment described above, the groove 125 is disposed in the front surface 121*a* of the baffle member 12. Therefore, the groove 125 can be disposed in a desired position in the front surface 121*a* of the baffle member 12, as long as the position is a position in which the groove 125 can be covered with the passage forming member 13.

Specifically, according to the present embodiment, the degree of freedom of arrangement of the vent passage P is higher than that of the conventional headphone.

In addition, according to the embodiment described above, the through hole 12*h* is disposed on the second end 125*b* side of the groove 125. By contrast, the through hole 13*h* is disposed near a position facing the first end 125*a* side of the groove 125 rather than the through hole 12*h*. Therefore, the substantial length of the vent passage P can be easily changed by changing the position of the through hole 13*h* in the passage forming member 13. Specifically, the characteristics in the low frequency range of the headphone 1 can be easily and finely adjusted.

In addition, according to the embodiment described above, the through hole 12*h* is disposed at the second end 125*b* of the groove 125. By contrast, the through hole 13*h* is disposed in a position facing the first end 125*a* of the groove 125. As a result, the groove 125 can be formed with a minimum length in accordance with the characteristics in the low frequency range of the headphone 1.

In addition, according to the embodiment described above, the cover member 16 includes a gap S5 establishing communication between the inner cover space S4 and the external space S6. As a result, when the air pressure in the front cavity S1 increases at the time when the headphone 1 is worn on the user or dropped, the air pressure in the front cavity S1 can be released to the external space S6 through the internal space of the through hole 13*h*, the inner passage space S3, the internal space of the through hole 12*h*, the inner cover space S4, and the gap S5.

In addition, according to the embodiment described above, the gap S5 is disposed over the entire circumference of the cover member 16. Therefore, the inner cover space S4 can be regarded as a space substantially equal to the external space S6. Specifically, when the air pressure in the front cavity S1 is released to the inner cover space S4 through the internal space of the through hole 13*h*, the inner passage space S3, and the internal space of the through hole 12*h*, the air pressure can be regarded to have been released to the external space S6.

In addition, according to the embodiment described above, the gap S5 is disposed between the first cover member 161 and the second cover member 162. Therefore, the gap S5 can be easily disposed over the entire circumference of the cover member 16.

In addition, according to the embodiment described above, the headphone 1 includes the housing 15 defining the rear cavity S2 with the baffle member 12. The front cavity S1 communicates with the inner cover space S4, not the rear cavity S2, through the vent passage P. Therefore, the sound waves output from the driver unit 11 to the front cavity S1 do not interfere with sound waves output from the driver unit 11 to the rear cavity S2.

In addition, according to the embodiment described above, the diameter of the through hole 12*h* is smaller than the diameter of the through hole 13*h*. The cross-sectional area of the vent passage P is larger than each of the opening area of the through hole 12*h* and the opening area of the through hole 13*h*. Accordingly, inside the vent passage P, flow of the air is controlled with the through hole 12*h* having the smallest cross-sectional area as the passage of the air. As a result, the change quantity of the characteristics in the low frequency range of the headphone 1 for the change quantities of the length and the width of the groove 125 is smaller than that in the case where the cross-sectional area of the vent passage is the same as each of the opening areas of the two through holes. Specifically, changing the length and/or the width of the groove 125 enables finer adjustment of the characteristics in the low frequency range of the headphone 1.

The gap included in the cover member may be a through hole, as long as the gap establishes communication between the inner cover space and the external space. In addition, the gap is not necessarily disposed over the entire circumference of the cover member.

In addition, the first cover member and the second cover member may be integrally formed.

Further, the headphone may be a feedback-type noise-canceling headphone including only the first microphone, or may be a feedforward-type noise-canceling headphone including only the second microphone. As another example, the headphone may be a headphone without a noise-canceling function.

In addition, the groove is not limited to an L shape, as long as the groove is a long groove having a length and a width enabling suppression of deterioration in characteristics in the low frequency range of the headphone to some extent. Specifically, for example, the groove may have a straight-line shape, a C shape, a U shape.

In addition, the width of the groove may be configured to increase continuously or intermittently from the first end toward the second end. In this case, the diameter of the through hole of the baffle member may be configured to increase in accordance with the width of the second end of the groove.

In addition, the shape of the groove in cross-sectional view is not limited to a rectangular shape. Specifically, for example, the shape of the groove in cross-sectional view may be a semicircular shape or a triangular shape.

In addition, the baffle member may include a plurality of grooves forming a plurality of vent passages. Specifically, for example, the left sound emission unit may include a plurality of vent passages. In this case, in the vent passages, the shortest vent passage or the vent passage having the largest cross-sectional area influences the characteristics in the low frequency range of the headphone.

In addition, the passage forming member may be slidable with respect to the baffle member. In this case, the length of the vent passage can be easily changed by sliding the passage forming member.

In addition, according to the embodiment described above, the groove 125 is disposed in the front surface 121*a* of the baffle member 12. Instead of this configuration, the groove of the baffle member may be disposed in the rear surface of the baffle member. In this case, the passage forming member is attached to the rear surface of the baffle member to form the vent passage with the baffle member.

Figure 12:
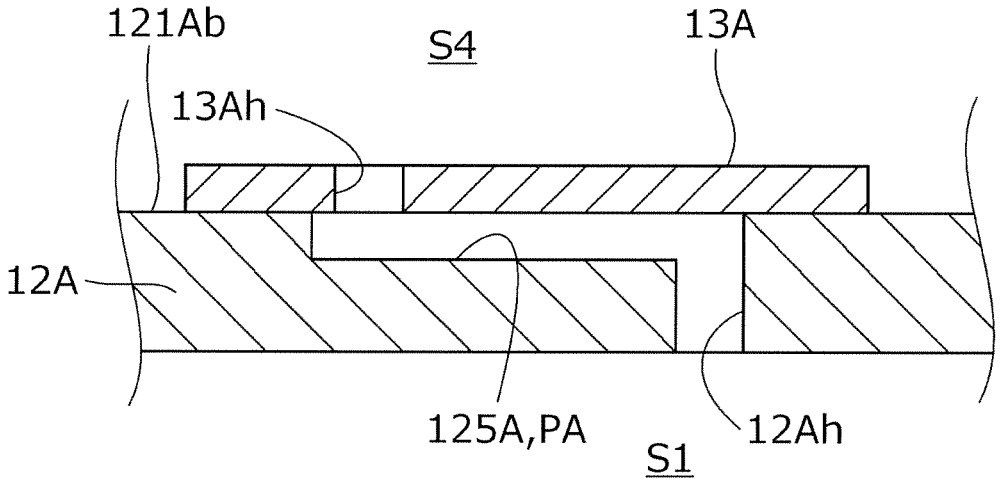
FIG. 12 is a partial cross-sectional schematic diagram schematically illustrating a modification example of the headphone according to the present invention.

FIG. 12 is a partial cross-sectional schematic diagram schematically illustrating a modification example of the headphone according to the present invention.

FIG. 12 illustrates that a groove 125A is formed in a rear surface 121Ab of a baffle member 12A. FIG. 12 illustrates that a passage forming member 13A is attached to the rear surface 121Ab of the baffle member 12A to cover the groove 125A. The groove 125A and the passage forming member 13A form a vent passage PA. In this case, the front cavity S1 communicates with the inner cover space S4 through a through hole 12Ah of the baffle member 12A, the vent passage PA, and a through hole 13Ah of the passage forming member 13A. Even in this case, in the headphone according to the present invention, the air pressure in the front cavity S1 can be released to the inner cover space S4 (external space S6), and the characteristics in the low frequency range of the headphone can be easily and finely adjusted, with a simple configuration.

In addition, according to the embodiment described above, the groove 125 is disposed in the front surface 121*a* of the baffle member 12. Instead of this configuration, the groove of the baffle member may be disposed in each of the front surface and the rear surface of the baffle member. In this case, a passage forming member is attached to each of the front surface and the rear surface of the baffle member, and forms the vent passages with the baffle member.

Figure 13:
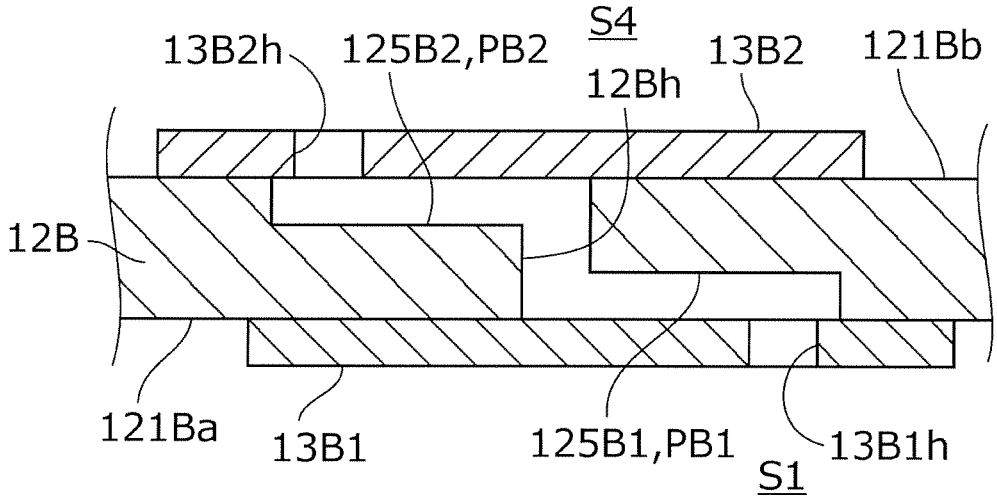
FIG. 13 is a partial cross-sectional schematic diagram schematically illustrating another modification example of the headphone according to the present invention.

FIG. 13 is a partial cross-sectional schematic diagram schematically illustrating another modification example of the headphone according to the present invention.

FIG. 13 illustrates that a groove 125B1 is disposed in a front surface 121Ba of a baffle member 12B, and a groove 125B2 is disposed in a rear surface 121Bb of the baffle member 12B. FIG. 13 illustrates that a first passage forming member 13B1 is attached to the front surface 121Ba of the baffle member 12B to cover the groove 125B1, and a second passage forming member 13B2 is attached to the rear surface 121Bb of the baffle member 12B to cover the groove 125B2. The groove 125B1 and the first passage forming member 13B1 form a first vent passage PB1. The groove 125B2 and the second passage forming member 13B2 form a second vent passage PB2. The first vent passage PB1 communicates with the second vent passage PB2 through a through hole 12Bh of the baffle member 12B. A through hole 13B1*h* of the first passage forming member 13B1 communicates with the first vent passage PB1, and a through hole 13B2*h* of the second passage forming member 13B2 communicates with the second vent passage PB2. In this case, the front cavity S1 communicates with the inner cover space S4 through the through hole 13B1*h*, the first vent passage PB1, the through hole 12Bh, the second vent passage PB2, and the through hole 13B2*h*. Even in this case, in the headphone according to the present invention, the air pressure in the front cavity S1 can be released to the inner cover space S4 (external space S6), and the characteristics in the low frequency range of the headphone can be easily and finely adjusted, with a simple configuration.

In addition, according to the embodiment described above, the vent passage P is formed with the groove 125 of the baffle member 12 and the passage forming member 13. Instead of this configuration, the vent passage may be formed with a groove included in the passage forming member and the baffle member. Specifically, for example, the passage forming member may include a groove forming the vent passage. In this case, the through hole of the passage forming member is disposed in the groove.

Figure 14:
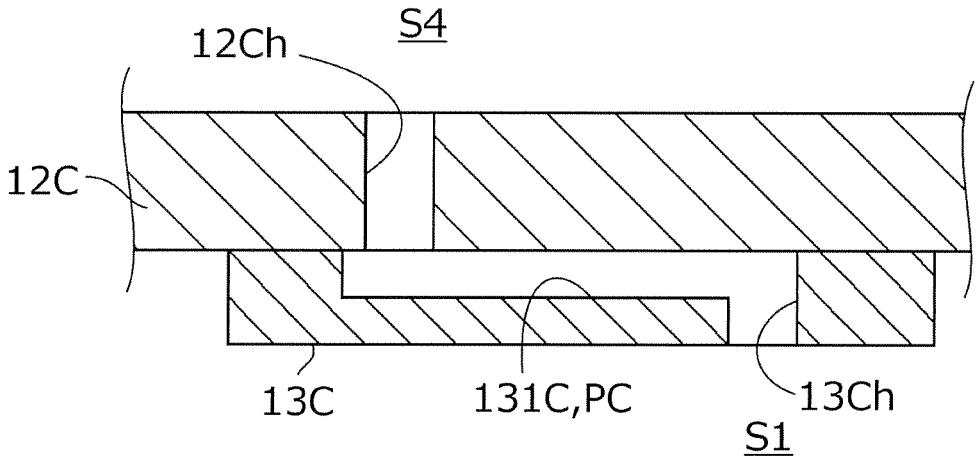
FIG. 14 is a partial cross-sectional schematic diagram schematically illustrating still another modification example of the headphone according to the present invention.

FIG. 14 is a partial cross-sectional schematic diagram schematically illustrating another modification example of the headphone according to the present invention.

FIG. 14 illustrates that a passage forming member 13C includes a groove 131C. FIG. 14 illustrates that the passage forming member 13C is attached to a front surface 121Ca of a baffle member 12C such that the groove 131C faces a through hole 12Ch of the baffle member 12C. The groove 131C is covered with the baffle member 12C. The baffle member 12C and the groove 131C form a vent passage PC. The through hole 12Ch of the baffle member 12C communicates with the vent passage PC. A through hole 13Ch of the passage forming member 13C communicates with the vent passage PC. In this case, the front cavity S1 communicates with the inner cover space S4 through the through hole 13Ch, the vent passage PC, and the through hole 12Ch. In this configuration, the passage forming member 13C may be attached to a rear surface 121Cb of the baffle member 12C. Even in this case, in the headphone according to the present invention, the air pressure in the front cavity S1 can be released to the inner cover space S4 (external space S6), and the characteristics in the low frequency range of the headphone can be easily and finely adjusted, with a simple configuration.

In addition, in the headphone according to the embodiment described above, the vent passage P is formed with the groove 125 of the baffle member 12 and the passage forming member 13. Instead of this configuration, the vent passage may be formed with a groove included in the baffle member and a groove included in the passage forming member. Specifically, for example, each of the baffle member and the passage forming member may include grooves forming a vent passage.

Figure 15:
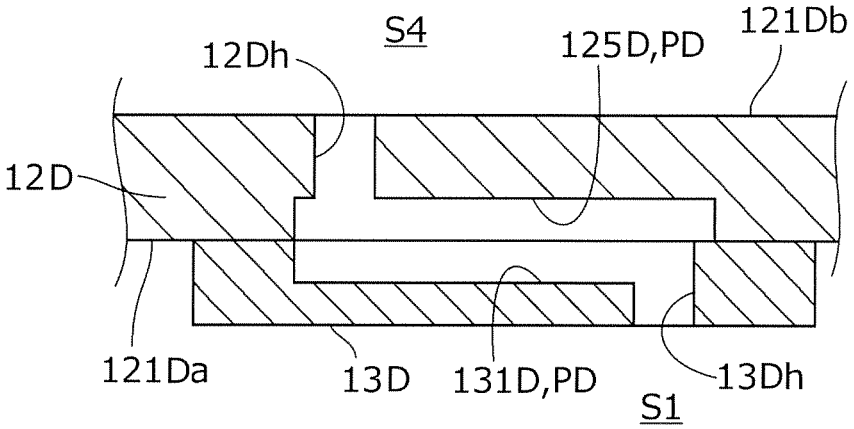
FIG. 15 is a partial cross-sectional schematic diagram schematically illustrating still another modification example of the headphone according to the present invention.

FIG. 15 is a partial cross-sectional schematic diagram schematically illustrating another modification example of the headphone according to the present invention.

FIG. 15 illustrates that a baffle member 12D includes a groove 125D, and a passage forming member 13D includes a groove 131D. FIG. 15 illustrates that the passage forming member 13D is attached to front surface 121Da of the baffle member 12D such that the groove 131D faces the groove 125D. The groove 125D and the groove 131D form a vent passage PD. A through hole 12Dh of the baffle member 12D communicates with the vent passage PD. A through hole 13Dh of the passage forming member 13D communicates with the vent passage PD. In this case, the front cavity S1 communicates with the inner cover space S4 through the through hole 13Dh, the vent passage PD, and the through hole 12Dh. In this configuration, the groove 125D may be disposed in a rear surface 121Db of the baffle member 12D, and the passage forming member 13D may be attached to the rear surface 121Db of the baffle member 12D. Even in this case, in the headphone according to the present invention, the air pressure in the front cavity S1 can be released to the inner cover space S4 (external space S6), and the characteristics in the low frequency range of the headphone can be easily and finely adjusted, with a simple configuration.

In addition, in the headphone according to the embodiment described above, the vent passage P is formed with the groove 125 of the baffle member 12 and the passage forming member 13. Instead of this configuration, the vent passage may be formed with a slit included in the baffle member and two passage forming members. Specifically, for example, the baffle member may include a slit penetrating through the front surface and the rear surface.

Figure 16:
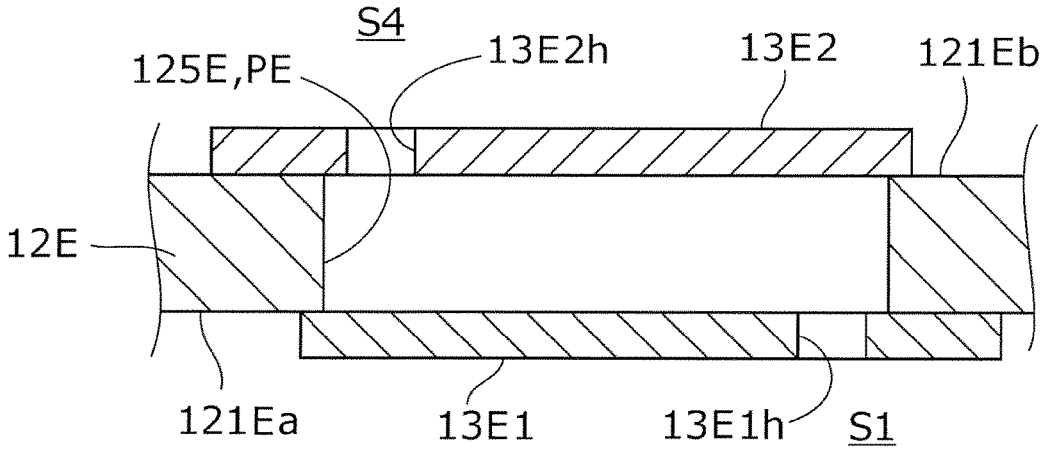
FIG. 16 is a partial cross-sectional schematic diagram schematically illustrating still another modification example of the headphone according to the present invention.

FIG. 16 is a partial cross-sectional schematic diagram schematically illustrating another modification example of the headphone according to the present invention.

FIG. 16 illustrates that a slit 125E penetrating through a front surface 121Ea and a rear surface 121Eb of a baffle member 12E is disposed in the baffle member 12E. FIG. 16 illustrates that a first passage forming member 13E1 is attached to the front surface 121Ea of the baffle member 12E to cover the slit 125E, and a second passage forming member 13E2 is attached to the rear surface 121Eb of the baffle member 12E to cover the slit 125E. The slit 125E, the first passage forming member 13E1, and the second passage forming member 13E2 form a vent passage PE. In this case, the front cavity S1 communicates with the inner cover space S4 through a through hole 13E1*h* of the first passage forming member 13E1, the vent passage PE, and a through hole 13E2*h* of the second passage forming member 13E2. Even in this case, in the headphone according to the present invention the air pressure in the front cavity S1 to the inner cover space S4 (external space S6), and the characteristics in the low frequency range of the headphone can be easily and finely adjusted, with a simple configuration.

The invention claimed is:

1. A headphone comprising:

a driver unit generates sound waves based on an electrical signal;

a baffle member that holds the driver unit;

a passage forming member that is attached to the baffle member and forms a vent passage with the baffle member;

an ear pad that is attached to the baffle member and defines a first space with the baffle member; and a cover member that is attached to the baffle member and defines a second space with the baffle member, wherein the baffle member includes:

a first surface that faces the first space;

a second surface that faces the second space; and a first through hole that communicates with an internal space of the vent passage, the passage forming member includes a second through hole that communicates with the internal space of the vent passage, the second space communicates with an external space of the cover member, and the first space communicates with the second space through the first through hole, the vent passage, and the second through hole.

2. The headphone according to claim 1, wherein the baffle member includes a groove that forms the vent passage, the first through hole is disposed in the groove, and the groove is covered with the passage forming member.

3. The headphone according to claim 2, wherein the groove is disposed in the first surface.

4. The headphone according to claim 2, wherein the groove is disposed in the second surface.

5. The headphone according to claim 2, wherein the first through hole is disposed on one end side of the groove.

6. The headphone according to claim 5, wherein the second through hole is disposed in a position facing another end side of the groove beyond the first through hole.

7. The headphone according to claim 5, wherein the first through hole is disposed at one end of the groove, and the second through hole is disposed in a position facing another end of the groove.

8. The headphone according to claim 1, wherein the cover member includes a gap that establishes communication between the second space and the external space.

9. The headphone according to claim 7, wherein the gap is disposed over entire circumference of the cover member.

10. The headphone according to claim 8, wherein the cover member includes:

a first cover member; and a second cover member, wherein the gap is disposed between the first cover member and the second cover member.

11. The headphone according to claim 1, further comprising:

a housing that is attached to the baffle member and defines a third space with the baffle member, wherein the housing accommodates the driver unit, and the second surface faces the third space.

12. The headphone according to claim 1, wherein the passage forming member includes a groove that forms the vent passage, the second through hole is disposed in the groove, and the groove is covered with the baffle member.

13. The headphone according to claim 1, wherein a diameter of the first through hole is smaller than a diameter of the second through hole.

14. The headphone according to claim 1, wherein a cross-sectional area of the vent passage is larger than each of an opening area of the first through hole and an opening area of the second through hole.

15. The headphone according to claim 1, further comprising:

a microphone that collects sound waves from the external space, wherein the microphone is accommodated in the cover member, and the first through hole faces the microphone.

* * * * *